United States Patent [19]

Simpson

[11] 4,065,929

[45] Jan. 3, 1978

[54] MINE ROOF SUPPORT AND METHOD IN LONGWALL MINING OF THICK MINERAL SEAMS

[75] Inventor: Terry Lee Simpson, Westminster, Calif.

[73] Assignee: Atlantic Richfield Company, Los Angeles, Calif.

[21] Appl. No.: 664,437

[22] Filed: Mar. 8, 1976

[51] Int. Cl.[2] ..... E21D 15/44

[52] U.S. Cl. ..... 61/45 D; 299/11; 299/33

[58] Field of Search ..... 299/11, 31–34, 299/43; 61/45 D

[56] References Cited

U.S. PATENT DOCUMENTS

| | | | |
|---|---|---|---|
| 3,370,431 | 2/1968 | Adcock et al. | 61/45 D |
| 3,606,758 | 2/1969 | Gotze | 61/45 D |

FOREIGN PATENT DOCUMENTS

| | | | |
|---|---|---|---|
| 1,340,491 | 12/1973 | United Kingdom | 61/45 D |

OTHER PUBLICATIONS

Longwall Mining with Sublevel Caving," Mining Congress Journal, Dec. 1972 pp. 43–48.

*Primary Examiner*—Ernest R. Purser
*Attorney, Agent, or Firm*—Robert M. Betz

[57] ABSTRACT

A bi-directional shearing machine mines a longwall face at the bottom of a thick mineral seam in a retreat operation under the protection of a row of adjacent powered roof supports each of which extends in a direction transverse to the solid face. Progressive advance of these roof supports allows the overlying mineral strata to cave. Each roof support is separated into articulated forward and aft units provided with separate sets of hydraulic props and having their solid canopies interfitted in end-to-end relation. The bases of the two units are interconnected with a push-pull hydraulic ram which enables relative longitudinal movement between the two units so that they may be advanced independently along a common axis toward the solid longwall face as the work progresses. During the advance of the forward units to provide face support, plowing and loading of caved mineral on the gob side may proceed without interruption. To accelerate caving, the aft units are independently advanced with an attached gob side chain conveyor and gob plow retracted beneath their canopies for protection. Starting from this retracted position, the gob conveyor and gob plow are allowed to load gradually out into the flushed coal.

8 Claims, 17 Drawing Figures

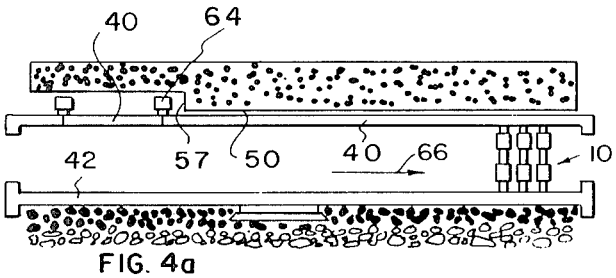
FIG. 4a
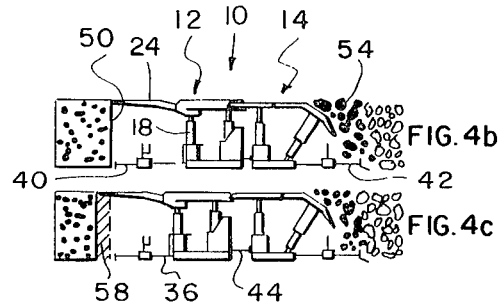
FIG. 4b
FIG. 4c
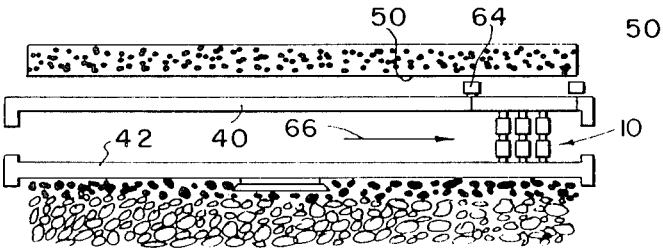
FIG. 5a
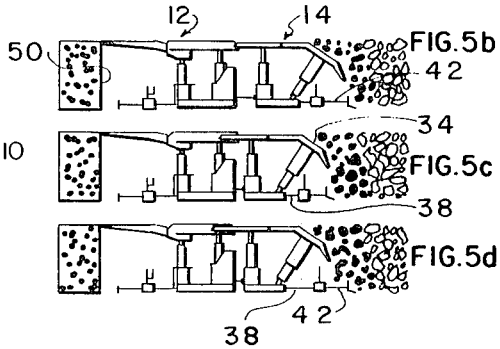
FIG. 5b
FIG. 5c
FIG. 5d
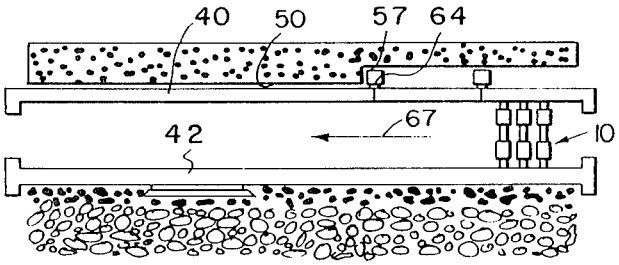
FIG. 6a
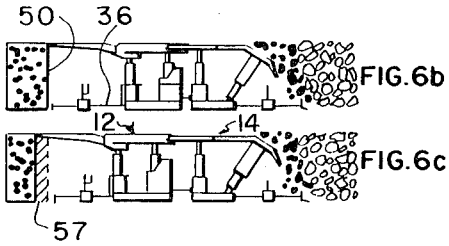
FIG. 6b
FIG. 6c
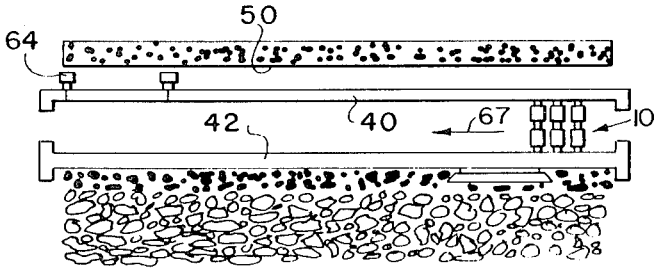
FIG. 7a
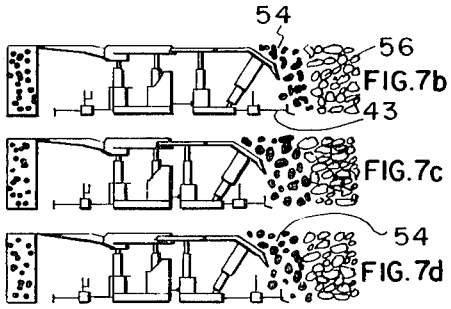
FIG. 7b
FIG. 7c
FIG. 7d

MINE ROOF SUPPORT AND METHOD IN LONGWALL MINING OF THICK MINERAL SEAMS

BACKGROUND OF THE INVENTION

1. Field of the Invention

This invention relates generally to the field of longwall mining and more particularly to a novel mine roof support structure and method of operation adapted for use in underground mining of thick mineral seams.

2. Description of the Prior Art

A known method of mining thick underground seams of coal or other mineral involves driving parallel head- and tailgate development entries into a mineral seam to define a panel to be mined and recovered in a retreating longwall operation. Typically, the seam is exploited by cutting a slice at the bottom and allowing the overlying mineral to cave.

The mechanization of thick seam longwalling with induced sublevel caving in the above manner is reported, for example, in the *Mining Congress Journal* for Dec., 1972, in an article entitled "Longwall Mining with Sublevel Caving". The longwall face extending between head- and tailgate entries may be cut bi-directionally with a double-drum shearer which loads an armored chain-type face conveyor at the solid face under the protection of a row of self-advancing adjacent mine roof supports, each extending transversely to the solid face. As the shearer passes each position along the face, the roof supports are progressively advanced to support the newly exposed mine roof while mineral from overlying strata on the gob side is allowed to cave for subsequent loading by plow or planer on a gob side chain conveyor extending along the opposite side of the row of roof supports.

Most of the production comes from the caved mineral, which means that recovery is importantly affected by how quickly and completely the overlying mineral caves and how the mineral-gob interface behaves. Factors to be considered in this connection are the friability of the mineral, the height of the seam, and the type of rock overlying the initially caved mineral. The manner in which caving is induced and the technique for loading the caved mineral, in synchronization with loading operations on the face side, particularly where the distance between face and gob conveyors varies, are considerations of primary importance in the present invention.

The essential intermediate element in a mechanized system of this sort is the roof support. Existing roof support structures are provided with hydraulic rams by means of which the face and the gob sides of each transversely extending support structure may be attached respectively to the face and gob chain conveyors. In operation, one mining team can be occupied with the shearing and the movement of the face conveyor while another team may be working on the drawing of caved mineral, the advancement of the supports, and the advancement of the gob conveyor. In the European system the roof support is typically supplied by means of so-called "walking" supports. These may, for example, be so-called two-step or double action assemblies wherein a pair of spaced apart parallel monolithic roof supporting frames or roof bars, each carried above a separate base by a number of pressurizable hydraulic props, are interconnected by advancing means positioned between them. By alternately anchoring and depressurizing the respective props of the two frames, the units may be successively advanced toward the solid mineral face, each using the other in turn as an abutment.

With supports as described, advancement of the face and gob conveyors may be performed by operating the rams at the two extremities of each support structure simultaneously with the advance of the supports themselves. However, even though the walking type support is articulated, its two sections are moved as a part of a single advancing operation. In other words, mining does not proceed with one unit or section advanced with respect to the other. This in turn interrupts the continuity of mining operations on the face and gob sides and hence the rate of mineral recovery. The essentially monolithic character of the roof structures also lessens their ability to accommodate varying distances between face and gob conveyors.

A related problem is longwalling which must be dealt with is how to provide prompt support for the roof area exposed by the lateral advance of the shearing machine along the longwall face. One way to do this is to incorporate hydraulically operated telescoping extension in the roof contacting superstructures of the supports. These extensions may be advanced to the solid face behind the advancing shearer without interruption of the mining cycle and without moving the upstanding hydraulic props. However, the cantilevered length of load bearing frame or bar is thereby increased, and the support density is thereby weakened. Since there is normally a considerable separation between the adjacent frames at interconnected roof support units, wire mesh or netting must be placed against the exposed roof between them to further contain fractured mineral. Such wire netting is also used to protect the gob conveyor but inevitably slows down the recovery of caved mineral which must be tapped through windows cut in the netting. In order to accelerate the flow of caved mineral through windows in the wire netting, curved, hinged aft roof support sections called "bananas" may be "pumped" or flexed. It has also been suggested that these banana canopies may be replaced by articulated shields which can be retracted during sublevel caving.

SUMMARY OF THE INVENTION

It is a general object of this invention to provide an improved self-advancing mine roof support and method for longwall mining of thick mineral seams.

It is another object of this invention to provide such a roof support and method adapted to facilitate continuous mining and loading at both face and gob sides of such roof support.

It is a further object of this invention to provide such a roof support and method which enables the maintenance of lateral flexibility between the face and gob side chain conveyors.

It is a still further object of this invention to provide such a roof support and method adapted to accelerate mining of the caved mineral.

It is yet another object of this invention to provide such a roof support and method wherein the integrity of the roof region in the vicinity of the support can be controlled without employment of wire netting or temporary timber support.

It is still another object of this invention to provide such a roof support and method wherein the transmission of undesirable torques or unbalanced forces from one unit to an adjacent unit of support structures may be eliminated.

In a preferred embodiment of this invention, an improved mine roof support comprises a pair of elongated forward and aft roof support units extending along a common axis with their solid canopies in interfitted end-to-end relation, a plurality of collapsable hydraulic props for independently pressurizing each of said units, a push-pull type intermediate hydraulic ram aligned with and interconnected between the two units of each support for moving such units relative to each other in an axial direction, and a pair of additional hydraulic rams for interconnecting the respective forward and aft units with a face and gob side chain conveyor. The forward units are independently advanceable without affecting the position of the face conveyor. The gob conveyor, together with an attached plow, are retractable beneath the aft unit canopy during the advance of the aft unit toward the solid face.

The invention also comprehends the improved method of longwall mining of an underground thick mineral seam with induced sublevel caving wherein a row of self-advancing roof supports are aligned with a longwall face to be mined in retreat including the steps of articulating each of the roof supports to enable independent advancement of the separate forward and aft units thereof along a common axis transverse to the longwall face, interfitting the solid canopies of said forward and aft units so that the effective roof support span of said supports may be increased without exposing any substantial intermediate roof area to absence of load bearing support, advancing the forward units of the roof supports to provide immediate face roof support accompanying lateral advance of the longwall mining machine without interruption of gob side mineral loading, advancing the aft units of the roof supports to accelerate additional caving of gob side coal while maintaining the gob conveyor and attached plow in a retracted condition thereunder, and thereafter gradually working the gob conveyor and plow into the flushed mineral to facilitate further loading thereof on the gob conveyor.

BRIEF DESCRIPTION OF THE DRAWINGS

FIG. 4*a* is a diagrammatic layout of a thick mineral seam operation in which a web is being sheared from a longwall face in a left to right direction while caved mineral is being simultaneously mined on the gob side. FIGS. 4*b* and 4*c* are diagrammatic views illustrating successive stages in the advance of any of a plurality of mine roof supports in accordance with this invention as the mining of the longwall face in FIG. 4*a* progresses.

FIG. 5*a* is a diagrammatic layout of the operation of FIG. 4*a* after the illustrated pass has been completed. FIGS. 5*b*, *c* and *d* depict successive gob side positions which may be assumed by the roof support of FIGS. 4*b* and *c* without interrupting face side mining.

FIG. 6*a* is a diagrammatic layout of the operation of FIGS. 4*a* and 5*a* in which the longwall face is being further sheared from right to left on a return pass. FIGS. 6*b* and 6*c* are diagrammatic views illustrating successive stages in the continued advance of the mine roof support of FIGS. 5*b*, *c* and *d* as removal of the longwall face in FIG. 5*a* progresses.

FIG. 7*a* is a diagrammatic layout of the operation of FIG. 6*a* after the illustrated pass has been completed.

FIGS. 7*b*, *c* and *d* show successive gob side positions of the roof support of FIGS. 6*b* and *c* which may be assumed without interruption of face side mining.

DESCRIPTION OF THE PREFERRED EMBODIMENTS

Figure 1:
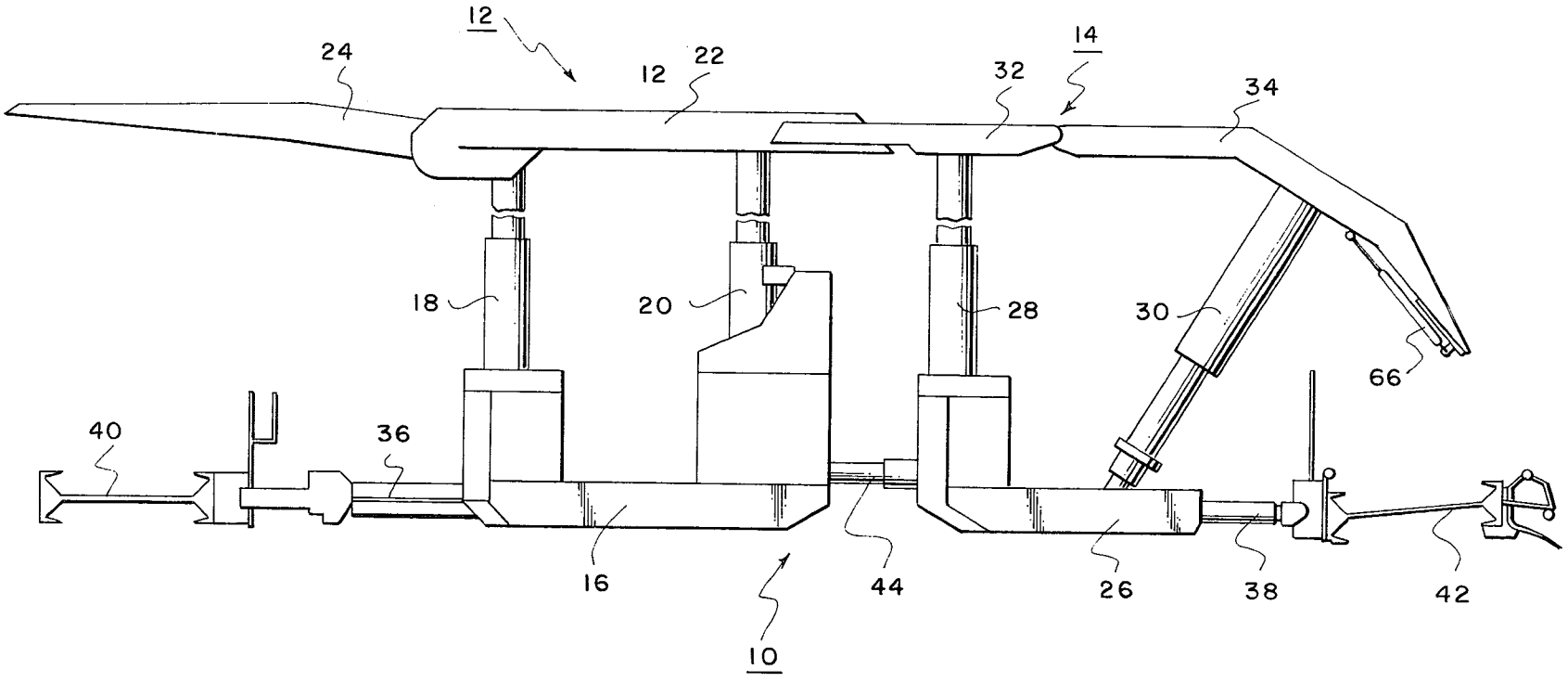
FIG. 1 is a side elevation of a mine roof support structure in accordance with this invention showing the articulated forward and aft support units with their interfitted solid canopies.

With reference now to FIG. 1, a mine roof support 10 in accordance with this invention comprises generally a forward unit 12 and an aft unit 14 joined end-to-end and extending along a common axis. The forward unit 12 is provided with a base 16 upon which are mounted a plurality of upwardly extending hydraulic props, such as props 18 and 20, which in turn support a roof contacting face canopy 22 and a flexible fore pole 24. In like manner, the aft unit 14 is provided with a shortened base 26 pm which are mounted a plurality of upwardly extending hydraulic props, such as props 28 and 30 designed to support the rear canopy 32 and the hinged and downwardly curving gob side extension bar or "banana" 34. The hydraulic ram 36 extends forward from the face side of the base 16, and a similar hydraulic ram 38 extends rearwardly from the gob side of the base 26. In a manner well-known in the art, the rams 36 and 38 are adapted to connect joining supports 10 with a face conveyor 40 and a gob conveyor 42 preferably of the chain-type. Interconnected between the facing portions of the forward and aft units 12 and 14 there is positioned an intermediate push-pull type hydraulic ram 44 of conventional construction in axial alignment therewith.

Figure 2:
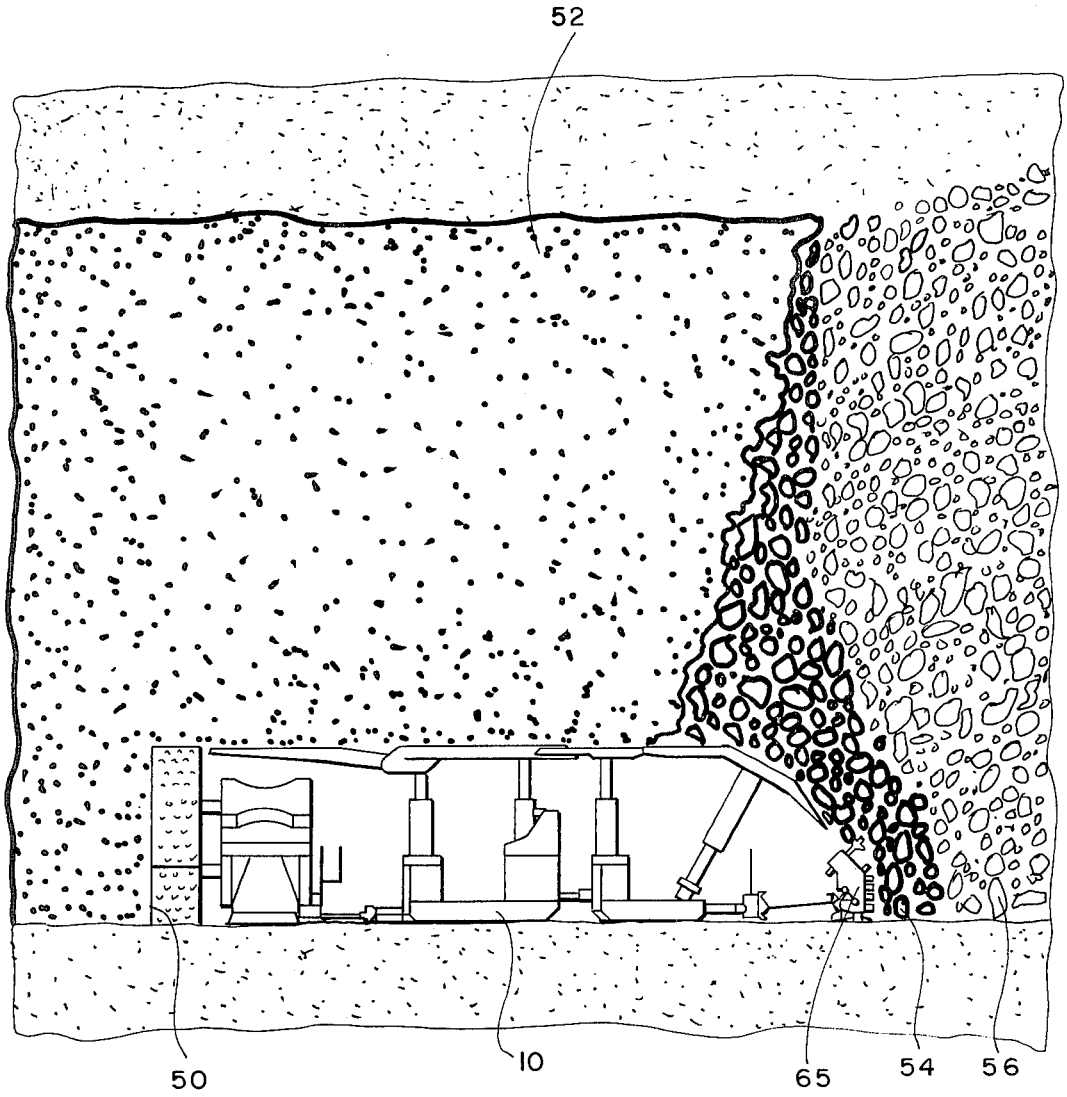
FIG. 2 is a diagrammatic vertical section through a thick mineral seam showing the placement of a mine roof support at the base thereof in accordance with this invention.
Figure 3:
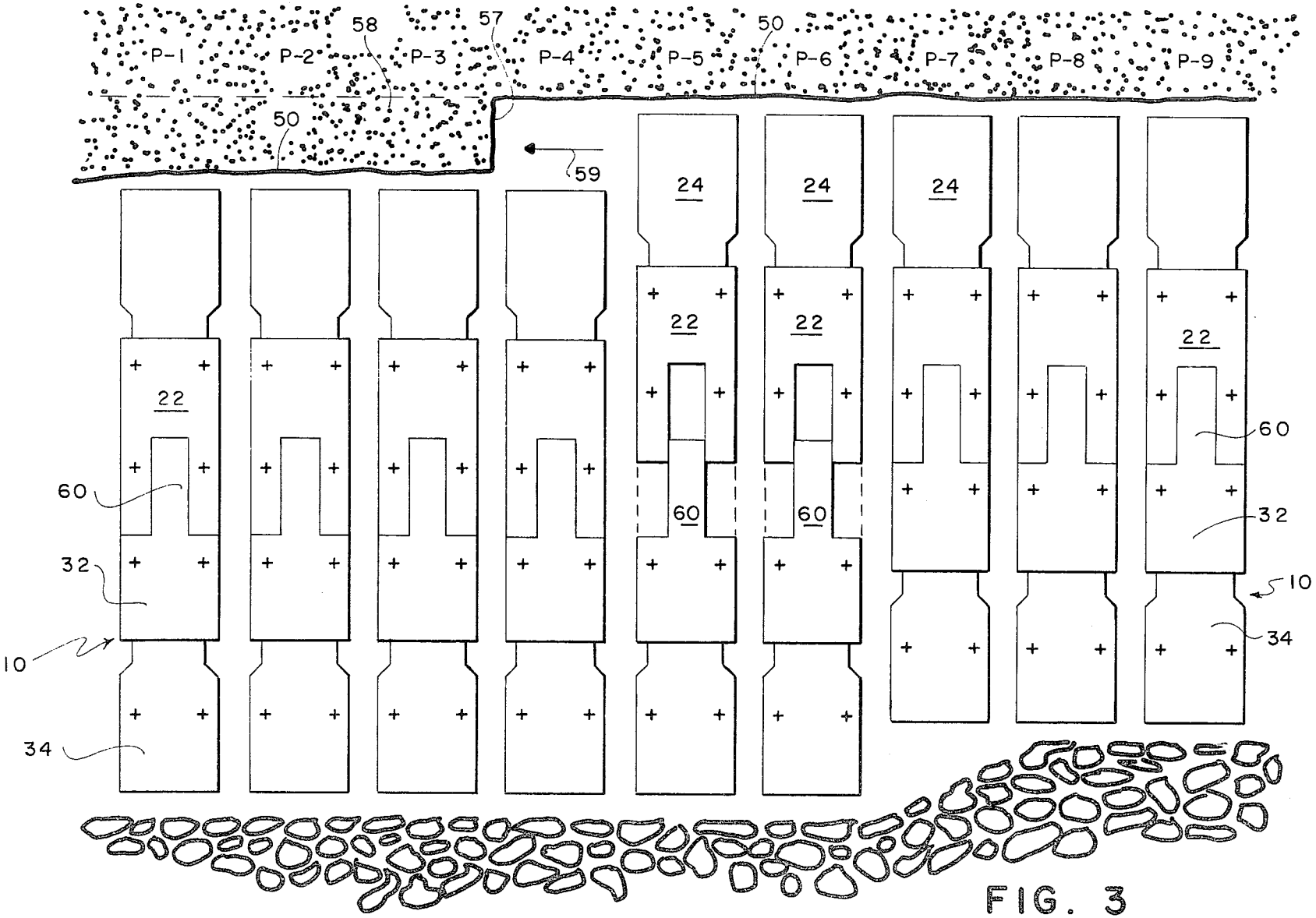
FIG. 3 is a diagrammatic plan view showing a series of mine roof supports in accordance with this invention disposed adjacent a solid mineral face, both ahead and behind a web being cut by a conventional bi-directional, double-drum shearing machine.

With additional reference now to FIGS. 2 and 3, there is shown a plurality of similar adjacent supports 10 extending transversely to a longwall face 50 formed at the bottom of a thick mineral seam 52. Shown on the aft side of the row of supports 10 is the broken mineral 54 and rock 56 which are allowed to cave on the gob side as the supports 10 advance to meet the retreating longwall face 50.

With further reference to FIG. 3, the supports 10 are shown both ahead and behind the narrow face 57 of the web 58 being cut from longwall face 50 by a conventional shearing machine (not shown) advancing laterally in the direction of arrow 59. In the positions *p*-1, *p*-2, and *p*-3, the face canopies 22 and rear canopies 32 are dovetailed together. In this position, tongue portions 60 are completely interfitted within correspondingly notched central portions of the back end of face canopies 22. As a shearing machine (not shown) advances in direction 59, the face canopies 22 and fore poles 24 of supports 10 in positions *p*-5 and *p*-6 are advanced to protect the newly exposed roof region. In these positions, the tongues 60 have disengaged partially from the face canopies 22. If desired, the small roof regions thereby exposed may be protected such as by means (not shown) affixed to the aft edge of the face canopies 22 which are upwardly rotatable to engage the forward edge of the rear canopies 32. Finally, in positions *p*-7, *p*-8, and *p*-9, the rear canopies 32 and bananas 34 have been advanced together so that the tongues 60 again dovetail completely with the face canopies 22 and a two-step advance of the supports 10 has been completed.

In order to understand the interrelation between the movement of the supports 10 and that of the face conveyor 40 and gob conveyor 42, reference is now made to the complete operating sequence as set forth in FIGS. 4*a* and *b;* 5*a, b* and *c;* 6*a* and *b;* and 7*a, b* and *c.* To avoid excessive detail, only a few of roof supports 10 are illustrated symbolically in FIGS. 4*a,* 5*a,* 6*a* and 7*a.* It will be understood however that a plurality of such supports 10 extend between face conveyor 40 and gob conveyor 42 both ahead of and behind the advancing shearing machine. With reference now to FIG. 4*a,* at the initial point of a mining sequence in accordance with this invention, the face conveyor 40 is pushed to the face 50 and a conventional shearer 64, such as a double-drum ranging machine, is positioned and begins its first cut in the direction of the arrow 66. As the shearer 64 cuts past each support 10 (FIG. 4*b*), the forward unit 12 of each support 10 is lowered, pulled to the face conveyor 40 by simultaneously extending the ram 44 and retracting the ram 36, and raised (step A-2) so that repositioned fore pole 24 provides immediate face support (FIG. 4*b*). During this process, the gob conveyor 42 is constantly in an extended position (toward the gob side) to allow continued plowing and loading of caved mineral 54 thereon without interruption. Also, since the unit 12 is advanced in its entirety the catilevered length of fore pole 24 extending forward of prop 18 remains constant without the necessity of moving face conveyor 40.

As mining continues on the gob side of the supports 10, excessive dilution will occur as mineral is depleted. When this happens, the gob conveyor 42 together with an attached gob plow, such as plow 65 (FIG. 2), is retracted beneath the banana 34 of units 14 by shortening ram 38 (FIG. 5*c*). Units 14 are then lowered, advanced toward the solid mineral face 50, and then reset (FIG. 5*c*). During this operation, the gob conveyor 42 and plow 65 remain protected from falling mineral or rock. Advance of rear units 14 involves retracting of intermediate rams 44. After these operations, the gob conveyor 42 is pushed outward toward the gob side by re-extending ram 38 (FIG. 5*d*), and plowing and loading recommences. This entire sequence may proceed without in any way interrupting the continuity of face side mining operations. The shearer 64, upon reaching the end of the longwall face 50 (FIG. 5*a*) and entering a gate entry (not shown), is prepared for its return cut as shown.

In FIG. 6*a,* the next operation in the sequence is to ram the face conveyor 40 over one web (FIG. 6*b*) with the aid of rams 36 and start the shearer 64 on its return pass in the direction of the arrow 67. Again, the forward units 12 are lowered, advanced, and raised by extending rams 44 to provide necessary face support after shearer 64 is past each support 10 (FIG. 6*c*). Plowing is continuous during these operations and is interrupted only during the advance of the gob conveyor 42. Note that the return pass of the shearer 64 does not necessarily have to wait for the advance of the aft sections 14. However, if it precedes such advance, immediate face support cannot normally take place until units 14 are advanced. However, if the available extension of rams 44 is as much as double that of the width of the web 58 to be cut, then aft units 14 may remain in the same position during two passes of the shearer 64.

As the caved mineral 54 is mined and large amounts of gob side rock 56 appear, the gob conveyor 42 is again retracted in the manner described above (FIG. 7*b*). The aft units 14 of supports 10 are lowered, advanced, and reset (FIG. 7*c*), and plowing begins after the rams 38 push the gob conveyor 42 toward the caved mineral 54 (FIG. 7*d*). The shearer 64 continues its return pass during these operations, and upon reaching the next gate entry (FIG. 7*a*) it prepares for another pass across the face 50 as shown.

An alternate embodiment of this invention eliminates the ram 44 in FIG. 1 while maintaining the dovetailing relationship of canopies 22 and 32. In these operations where independent advance of units 12 is required, this may be performed with the aid of double acting rams 36 using the face conveyor 40 and associated equipment as abutment. Similarly when aft sections 14 are to be advanced toward the solid face 50, power may be supplied by extension of double acting rams 38.

The embodiments of the invention in which an exclusive property of privilege is claimed are defined as follows:

1. In a longwall mining system, a roof support adapted to extend transversely between a face and a gob side conveyor comprising:

a. a forward and an aft chock-type roof supporting unit disposed in line, one behind the other, said forward and aft roof units each being supported by at least two pairs of side-by-side props, the rear end of the forward roof supporting unit being interconnected with the front end of the aft roof supporting unit so as to permit relative movement of said forward and aft roof supporting units in the direction of advance;

b. means for separately anchoring and depressurizing each of said units; and c. means for independently advancing either of said units in a depressurized state toward the longwall face.

2. In a longwall mining system, a roof support adapted to extend transversely between a face and a gob side conveyor comprising:

a. a forward and an aft chock type roof supporting unit disposed in line, one behind the other, the rear end of the forward roof supporting unit being interconnected with the front end of the aft roof supporting unit so as to permit relative movement of said forward and aft roof supporting units in the direction of advance;

b. means for separately anchoring and depressurizing each of said units; and c. a face side and a gob side push-pull hydraulic ram operatively interconnecting said forward and aft roof supporting units respectively with said face and gob conveyors to permit the independent advance of either of said roof supporting units without using the other as abutment.

3. The apparatus claimed in claim 2, additionally comprising an intermediate hydraulic ram operatively interconnecting said roof supporting units and adapted to be operated in push-pull fashion to enable each of said units to advance independently by employing the other as an abutment.

4. The apparatus claimed in claim 2 wherein said forward and aft roof supporting units include solid canopies rspectively adapted to engage the surface of the mine roof.

5. The apparatus claimed in claim 4 wherein said forward and aft canopies are interfitted in dovetailed relation.

6. The apparatus claimed in claim 5 wherein said canopies are of equal width.

7. The apparatus claimed in claim 6 wherein said canopies are maintained in slidable contact during the relative movement of said forward and aft roof supporting units.

8. In a system for longwall mining of a thick subsurface mineral seam wherein a longwall face is established below the top of the seam and wherein adjacent powered roof supports are progressively advanced to the longwall face as it is mined in retreat so as to induce sublevel caving of the overlying strata behind said advancing roof supports, the improvement wherein each of said roof supports comprises:

a. a forward and an aft chock-type roof supporting unit disposed in line, one behind the other, the rear end of the forward roof supporting unit being interconnected with the front end of the aft roof supporting unit so as to permit relative movement of said forward and aft supporting units in the direction of advance, each of said roof supporting units being provided with a solid roof-engaging canopy;

b. means for separately anchoring and depressurizing each of said units;

c. means for independently advancing either of said units in a depressurized state toward the longwall face; and d. ram means operatively interconnecting said aft roof supporting unit and said gob conveyor, whereby said gob conveyor may be retracted beneath the canopy of said aft roof supporting unit and maintained in said retracted position during the independent advance of said aft unit and thereafter extended in the direction of the caved mineral.

* * * * *